United States Patent [19]

Arribau et al.

[11] Patent Number: 4,850,702

[45] Date of Patent: Jul. 25, 1989

[54] METHOD OF BLENDING MATERIALS

[75] Inventors: Jorge O. Arribau, Englewood; Russell J. Dorn, Aurora, both of Colo.

[73] Assignee: GEO Condor, Inc., Stamford, Conn.

[21] Appl. No.: 216,035

[22] Filed: Jul. 7, 1988

Related U.S. Application Data

[63] Continuation of Ser. No. 118,407, Nov. 6, 1987, which is a continuation of Ser. No. 840,343, Mar. 17, 1986, abandoned, which is a continuation of Ser. No. 340,527, filed as PCT US80/00468 on Apr. 28, 1980, published as WO81/03143 on Nov. 12, 1981, abandoned.

[51] Int. Cl.[4] ..... B01F 15/02

[52] U.S. Cl. ..... 366/136; 366/155; 366/165

[58] Field of Search ..... 366/2, 10, 21, 22, 27, 366/30-34, 37, 60, 61, 65, 76, 131, 134, 136, 154, 155, 159, 160, 161, 168-172, 177-184, 191-196, 262-265, 279; 137/597; 141/244

[56] References Cited

U.S. PATENT DOCUMENTS

| | | | |
|---|---|---|---|
| 2,469,434 | 5/1949 | Hansen | 141/244 |
| 2,968,915 | 1/1961 | Feistel | 366/61 |
| 3,182,966 | 5/1965 | Carlsson | 366/136 |
| 3,741,533 | 6/1973 | Winn | 366/136 |
| 3,998,433 | 12/1976 | Iwako | 366/178 |
| 4,239,396 | 12/1980 | Arribau | 366/2 |
| 4,311,395 | 1/1982 | Doothitt | 366/30 |

*Primary Examiner*—Robert W. Jenkins
*Attorney, Agent, or Firm*—Curtis, Morris & Safford

[57] ABSTRACT

A truck-mounted apparatus is capable of blending liquid/liquid or liquid/solid constituents in a high capacity blending operation, and the apparatus achieves a high degree of versatility in the introduction of materials into a blender apparatus (10) for discharge from either or both sides of the truck or other vehicle. A closed loop system (12) permits suction of liquid maaterials as well as discharge of mixed materials from one or both sides of the truck, and is capable of flushing or other pumping operations as well. Moreover, the closed loop system (12) includes a pump (62) as a part of the closed loop system which, together with the blender (10), is operable off of a common drive, such as the power transmission train of the truck. The blender permits isolated injection of liquids and/or solid constituents through separate inlets, by means of dynamic seal, a first inlet (20) causing liquids to be introduced tangentially so as to swirl through a downwardly divergent annular chamber and the second inlet causing the materials to be introduced more in an axial direction through an impeller (16) which imparts a centrifugal force to drive the materials outwardly into the swirling stream of liquid.

23 Claims, 2 Drawing Sheets

METHOD OF BLENDING MATERIALS

This application is a continuation of application Ser. No. 118,407, filed Nov. 6, 1987, which was a continuation of application Ser. No. 840,343, filed Mar. 17, 1986, now abandoned, which in turn was a continuation of application Ser. No. 340,527, filed as PCT US80/00468 on Apr. 28, 1980, published as WO81/03143 on Nov. 12, 1981, now abandoned.

BACKGROUND OF THE INVENTION

In prior copending application for patent, Ser. No. 6,277, filed Jan. 25, 1979, now U.S. Pat. No. 4,239,396, disclosed a high capacity, truck-mounted blender in which a high speed impeller is mounted for rotation concentrically within an outer casing and has a solids inlet which is isolated from an outer concentric liquid inlet. In the preferred form of that invention, the blender is specifically designed for use in cementing operations or in fracturing oil and gas subsurface formations. The high speed impeller is positioned in inner spaced concentric relation to an annular chamber which causes the liquid to be directed axially past the discharge side of the impeller whereby solid material introduced through the central inlet is discharged by the impeller under centrifugal force into the fast-moving, axial stream of liquid. A mixing chamber diverges in an axial direction away from the impeller zone into a discharge port. Further, a recirculation inlet is provided to establish communication from the discharge side and the central or solids inlet so as to permit any excess of the blended material to be recirculated through the blender. A number of important advantages are seen to accrue from the isolation of the solids inlet from the liquid inlet, particularly at the interface across the impeller zone. Further, it has been found possible to greatly improve the blending of at least certain materials by closely controlling the movement of the liquid stream into the blender and along the annular space formed in surrounding relation to the impeller zone. Furthermore, it has been found that the versatility of the blender apparatus can be greatly enhanced by the use in combination therewith of a closed loop system which along with the blender can be vehicle-mounted and operated off the vehicle drive to regulate the delivery of materials to and from the blender as well as to regulate the discharge of blended materials from either side of the vehicle into a well head or other intended site of use.

SUMMARY OF THE INVENTION

It is therefore an object of the present invention to provide for a novel and improved liquid/liquid or liquid/solid blending method and apparatus which is adaptable for use in cementing and fracturing operations, such as, of the type employed in oil and gas wells.

It is another object of the present invention to provide for a high capacity blender method and apparatus in which the introduction of one of the constituents to be blended is completely isolated from the other constituents and is capable of intermixing the contituents in varying amounts in a high capacity blending operation.

It is a further object of the present invention to provide for a method of intermixing solid particulate materials with a high velocity, swirling liquid stream in which the solid materials are introduced through an inner zone isolated from the outer liquid zone by radially directed the solids under centrifugal force so as to intercept the liquid stream and be held in suspension for pumping to the site of intended use.

It is a further object of the present invention to provide for a novel and improved blending method and apparatus which can be vehicle-mounted and is conformable for mixing liquid-to-liquid or liquid-to solid constituents for continuous discharge to the intended point of use; and further wherein a closed loop system is employed in combination with the blender apparatus to regulate the capacity and pressure of liquid introduced into the blender as well as to control the discharge of blended materials and offers a high degree of versatility in the proportions and amounts of constituents to be blended as well as their delivery through one or more outlet or discharge ports.

In accordance with the present invention, there has been devised a novel and improved blending apparatus which is comformable for use in high capacity blending operations. In the preferred form, a truck-mounted blender apparatus has an inner solids inlet which extends axially into an impeller zone. The impeller is located in inner spaced concentric relation to an outer concentric chamber which has a tangentially directed liquid inlet for delivering liquid in a swirling, somewhat helically directed stream through the annular chamber and past the discharge side of the impeller zone. The impeller is so mounted between the solids inlet and annular chamber as to form a dynamic seal therebetween and assure the complete isolation of the solids from the liquids except at the point of discharge of the solids through the impeller zone into the swirling stream of liquid. The annular chamber is preferably designed so as to diverge along the impeller zone and create a slight reduction in pressure of the liquid stream as it advances toward the discharge end of the blender so as to assure that the solids will be carried with the liquid stream through the discharge port. A closed loop system is operative in combination with the blender to deliver liquid materials to the outer liquid inlet under a predetermined head of pressure which will not exceed the pressure limit of the blender, the system including a pump, the suction side of which is in communication with a series of inlet ports located along opposite sides of the truck so as to induce the delivery of materials from a liquid supply source for discharge under a predetermined pressure into the blender. Materials discharged from the blender are directed back through the closed loop system for discharge through the same or other ports located along opposite sides of the truck. The closed loop system is so designed that the same ports may be employed along opposite sides of the truck either for suction or discharge or can be so interconnected as to bypass the blender for flushing or other operations. A selected amount of the materials discharged from the blender may be recirculated through the closed loop system to the liquids inlet either for further blending or to reduce the amount of materials discharged to the intended point of use.

The method of the present invention carries out blending of liquids or liquid and solid constituents by introducing liquids from a closed loop system tangentially into a downwardly divergent annulus and simultaneously introducing liquid or solid materials to be mixed through a central inlet which discharges the materials through a lower outlet under a high degree of centrifugal force so as to be intimately mixed and blended with the swirling stream of liquid passing downwardly through the annulus. The materials discharged are circulated through the closed loop system for delivery through one or more outlets; or if desired, a selected amount can be recirculated through the outer annulus for further mixing and blending with additional materials introduced through the central inlet.

BRIEF DESCRIPTION OF THE DRAWINGS

Other objects, advantages and features of this invention will become appreciated and understood when taken together with the following detailed description in conjunction with the accompanying drawings, in which.

DETAILED DESCRIPTION OF THE PREFERRED EMBODIMENT

Figure 2:
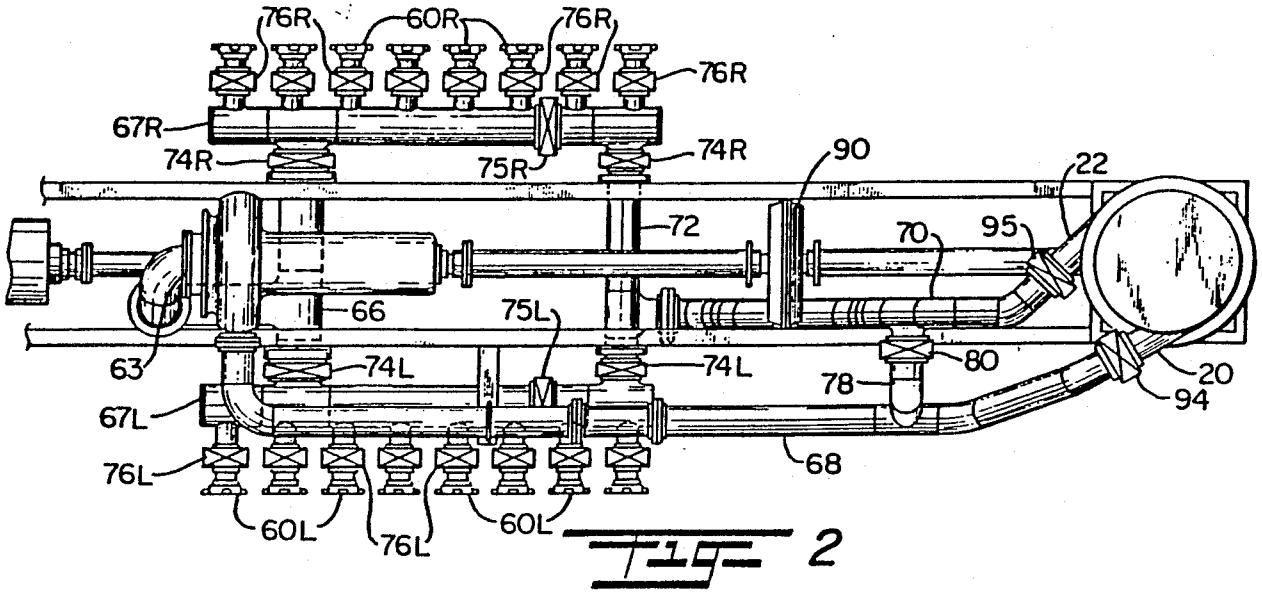
FIG. 2 is a plan view of the preferred embodiment shown in FIG. 1.
Figure 1:
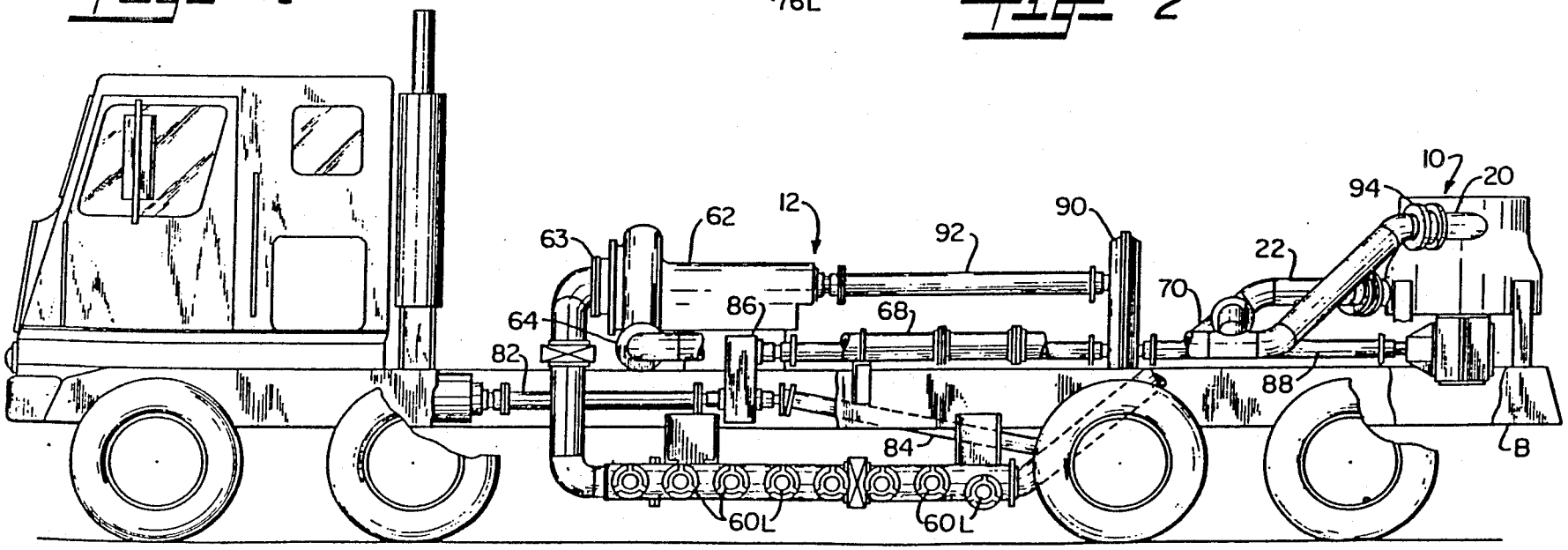
FIG. 1 is a side view in elevation illustrating the preferred embodiment of the present invention installed on a vehicle.

Referring in detail to the drawings, there is illustrated in FIGS. 1 and 2 a blender system in accordance with the present invention which is broadly comprised of a blender apparatus 10 and a closed loop liquid distribution apparatus 12. The blender apparatus 10 and distribution apparatus 12 are illustrated as being mounted on a truck bed B so as to be transportable to different intended sites of use. In this connection, the apparatus of the present invention in its preferred form will be described specifically in relation to intermixing of liquid and solid constituents which are to be discharged into a well head for fracturing oil or gas subsurface formations, although it will be appreciated that the apparatus is conformable for use in other applications, such as, for instance, cementing operations.

Figure 3:
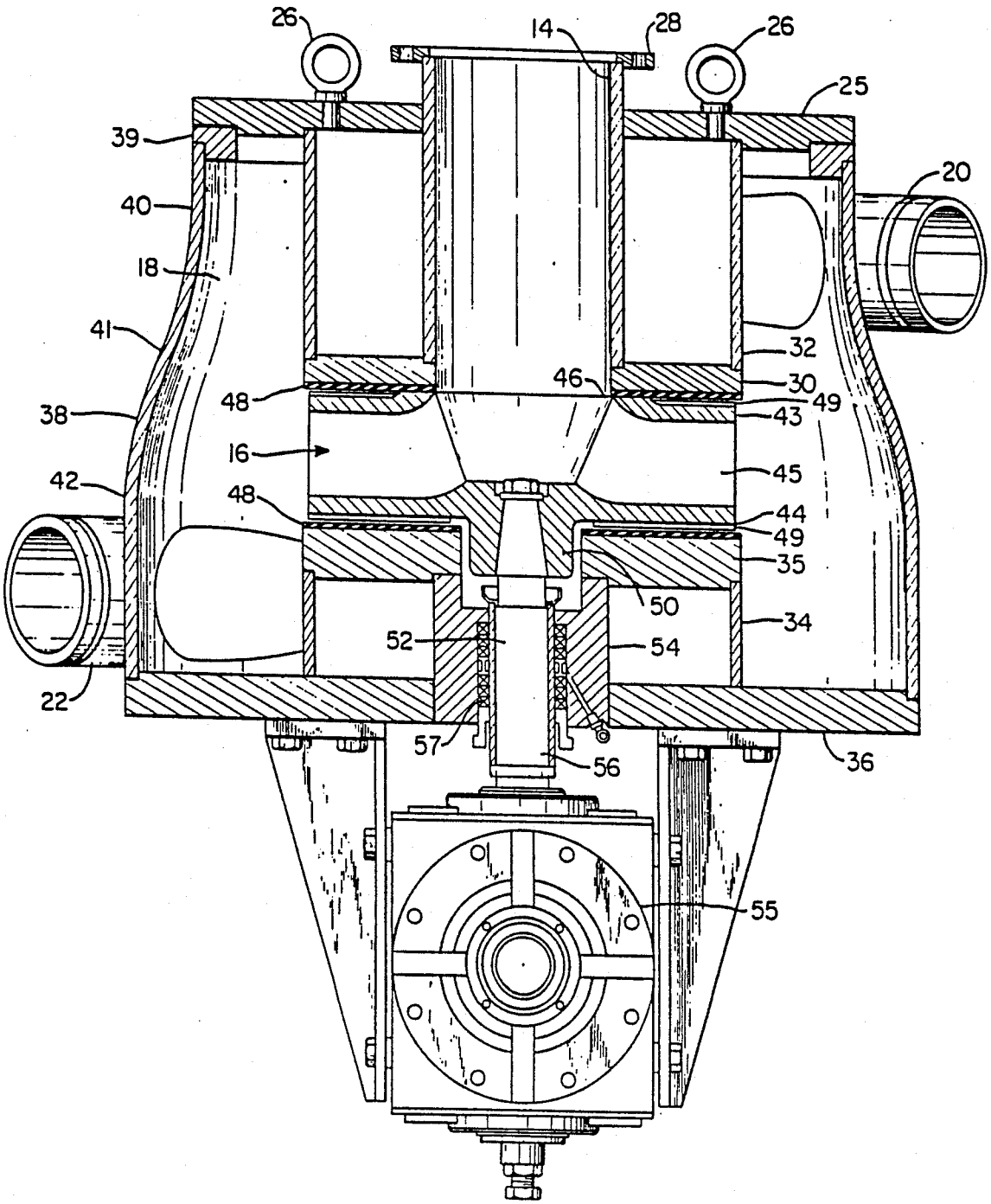
FIG. 3 is a cross-sectional view of the preferred form of blender as illustrated in FIGS. 1 and 2.

The preferred form of blender apparatus 10, as shown in FIG. 3, comprises a central, axially directed inlet 14, an impeller 16 which is mounted for rotation at the lower end of the inlet 14, and an annular chamber 18 in outer concentric relation to the inlet 14 has a tangentially directed liquid inlet 20 at its upper end and a tangentially directed outlet port 22 at its lower end. It will be noted that the annular chamber 18 diverges in a downward direction past the impeller zone and toward the discharge end 22, the chamber being completely open throughout so as to permit the uninterrupted flow of liquid therethrough. Preferably, the central inlet 14 is formed by a hollow cylindrical casing which is positioned to project upwardly through a central opening in an upper mounting plate 25, the mounting plate having suitable connecting rings 26 to facilitate movement and installation of the blender. The upper end of the inlet 14 has a connecting flange 28 to facilitate its attachment to a tubular conduit which forms a part of a solids conveyor system, for example, of the type referred to in the hereinbefore referred to copending application for patent Ser. No. 6,277, filed Jan. 25, 1979.

The lower edge of the casing 14 is seated at the inner edge of an annular plate 30 which defines the upper boundary of the impeller zone and extends horizontally in an outward radial direction from the lower end of the casing 14. A tubular wall section 32 has its lower edge positioned on the outer edge of the plate 30 and extends upwardly therefrom in outer spaced concentric relation to the casing 14 and terminates at the underside of the top plate 25 of the blender. The wall 32 defines the inner wall of the annular chamber 18 along the upper section of the chamber opposite the inlet 20. A lower wall section 34 corresponds in diameter to the upper wall section 32 and defines the inner wall of the annular chamber 18 beneath the impeller 16 and is aligned opposite to the discharge port 22. The lower wall section 34 is interposed between an upper horizontally extending, circular flange 35 and a horizontal base plate 36 which forms the lower horizontal end wall of the blender, the plate 36 being of generally annular or circular configuration with a central opening therein. An outer, downwardly divergent wall 38 defines the outer wall of the entire blender and of the annular chamber 18, the wall 38 being of generally tubular configuration having its upper end affixed to a mounting ring 39 extending around the underside of the outer peripheral edge of the top wall 25 of the blender, and a lower end of the wall 38 is affixed to the outer peripheral edge of the bottom plate 36 of the blender. The liquid inlet port 20 extends in a tangential direction through the upper end of the wall 38 directly beneath its attachment to the top wall 25, and the outlet port 22 extends tangentially away from the lower end of the wall 38 directly above the attachment of the wall into the base plate 36 of the blender. While the degree of divergency of the outer wall section 38 may vary, preferably, the wall is comprised of a relatively straight wall portion 40 which merges into an inclined wall portion 41 of progressively increasing diameter along a region generally opposite to the impeller zone and which merges into a lower, straight wall section 32 such that the area of the chamber at the lower end approximates twice the area of the chamber at its upper end.

Preferably, the impeller 16 corresponds to that disclosed in copending application for patent Ser. No. 6,277 and is made up of upper and lower spaced, radially extending walls 43 and 44, respectively, which are interconnected by vertically disposed, circumferentially spaced vanes 45, the vanes curving outwardly along a generally sprial path from a central opening 46, the opening 46 corresponding in diameter with the central inlet 14. In order to form a complete seal along the impeller zone so as to isolate the central inlet 14 in the annular chamber 18, the surfaces of the plates 30 and 35 in confronting relation to the upper and lower walls 43 and 44 of the impeller 16 are coated with layer 48 of low coefficient of friction material, and the confronting surfaces of the upper and lower wall sections 43 and 44 of the impeller are provided with circumferentially spaced ribs 49 of spiral configuration corresponding to the spiral configuration of the vanes 45 and which ribs 49 advance across the surfaces 48 as the impeller is rotated so as to tend to expel any liquid which would otherwise tend to flow radially outwardly along the interface between the impeller and surrounding plates 30 and 35.

The lower wall section 44 of the impeller is provided with a central hub 50 which is keyed for rotation on a drive shaft 52, the latter projecting downwardly through a fixed drive sleeve 54 and into a transmission drive housing 55 affixed to the bottom wall 36 of the blender. It will be noted that the drive shaft 52 is journaled within a bushing 56 which is supported by thrust bearings 57 within the sleeve 54.

Figure 4:
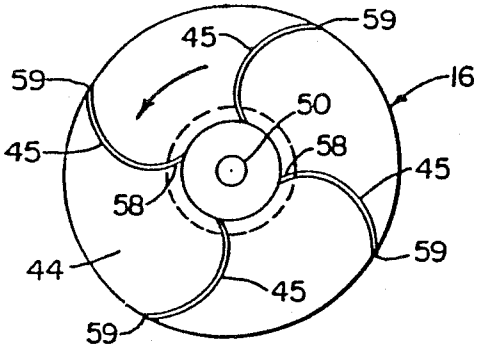
FIG. 4 is a cross-sectional view but of reduced size of the impeller illustrated in FIG. 4.

As shown in FIG. 4, vanes 45 preferably in the form of arcuate, generally radially extending blades are arranged at equally spaced circumferential intervals around the circular impeller, each blade having an inner inclined edge 58 and curving or bowing outwardly along its length to terminate in its outer vertical edge 59 which is flush with the outer extremities of the upper and lower wall sections 43 and 44. The vanes are bowed to present convex surfaces in the direction of rotation of the impeller whereby to encourage outward movement of material introduced through the central inlet 14 and to impart a high velocity to the material as is driven through the impeller region under centrifugal force into the liquid stream passing through the annular chamber 18. Since the impeller isolates the inlet 14 from the chamber 18, mixing of materials occurs only at the point of discharge of the material introduced through the inlet 14 as it passes from the outer radial extremities of the vanes 45 into the liquid stream and in a direction generally normal or perpendicular to the direction of flow of the liquid stream. In this relation, the liquid stream will follow somewhat of a helical path of advancement through the annular chamber by virtue of the tangential disposition of the inlet; and, by reason of the divergency of the chamber along the impeller region the velocity of the stream will be slowed somewhat as it reaches the impeller region but will tend to force the solid materials from the impeller to advance along the outer wall of the chamber 18. In general, the flow rate of the stream as determined by the inlet force or pressure of the liquid through the upper inlet 20 will be at a level such that it will be capable of picking up highly dense solid materials and throughly mixing the materials and maintaining them in suspension for discharge through the lower port 22.

The distribution system 12 broadly is constructed and arranged to pump liquid to the blender 10 from one or more of the ports 60L and 60R which are positioned in parallel along opposite sides of the truck bed B as well as to regulate the discharge of the mixture from the blender 10 through any one or more selected ports 60L and 60R which are not being employed as inlet ports. Preferably, the system 12 is a closed loop system which is capable of bypassing the blender and pumping liquid from a supply source through one or more of the ports 60 for direct discharge through other of the ports 60 either on the same or opposite side of the truck bed as the inlet ports. To this end, the distribution system 12 is made up of a centrifugal pump 62 which has an intake or suction end 63 and a discharge end 64. The inlet side 63 is connected into a forward, transversely extending pipe manifold 66 which interconnects outboard, left and right mainfolds 67L and 67R, respectively, disposed along opposite sides of the truck bed. In turn, the discharge side 64 is connected to a discharge conduit 68 leading therefrom and extending rearwardly for connection to the liquid inlet 20 of the blender 10 so as to pump liquid under a predetermined head of pressure from the pump 62 into the liquid inlet. Preferably, the centrifugal pump is a Model CK-6 pump manufactured by Morris Pumps, Inc. of Boldwinsville, N.Y. The pump has an impeller of a type corresponding to the impeller 16 of the preferred form of blender but of a smaller size so as to assure that the pressure generated by the pump will never exceed the designed pressure limit of the blender.

The outlet 22 of the blender is connected through a conduit 70 into a transversely extending rearward pipe mainfold 72 which interconnects the rearward ends of the outboard pipe mainfolds 67L and 67R. Valves 74 are positioned at opposite ends of the mainfolds 66 and 72 at their point of connection into the outboard manifolds 67L and 67R. In addition, main valves 75L and 75R are located in each of the outboard mainfolds 67L and 67R; and individual flow control valves 76L and 76R are provided for each of the ports 60L and 60R. It will also be seen that the discharge conduit 70 has a bypass connection 78 into the conduit 67R and a flow control valve 80 is positioned in the bypass conduit 78 to selectively open or close the bypass line between the conduits 67R, 70 for a purpose to be hereinafter described.

The truck as illustrated is of conventional design and for example may be a Model K2440 truck manufactured and sold by Oshkosh Trucks Corp. of Oshkosh, Wis. It is equipped with an Oshkosh 500 h.p. transmission as designated at 82 leading rearwardly from the front cab section of the truck along the chassis or truck bed and having a power takeoff shaft 84 into the rearward differential section of the truck all in a conventional manner. However, in accordance with the present invention, a transfer case 86 is interpositioned in the transmission train 82 so as to permit the impeller 16 of the blender 10 to be driven off of power takeoff shaft 88 leading from the transfer case 86. Another transfer case 90 is interpositioned in the power takeoff shaft 88 to drive another auxiliary drive shaft 92 for the centrifugal pump 62. By driving both the blender 10 and pump 62 off of a common power transmission, such as, that available as standard equipment on the truck, the pump 62 will not overrun the blender, or exceed its pressure limit, in supplying liquid under pressure thereto or, in other words, will maintain a balanced pressure condition therebetween.

In operation, the closed loop distribution system as described affords a high degree of versatility in permitting the system to be connected to a suitable liquid supply source from either side of the truck through any one or more of the inlet ports 60L and 60R. Typically, the inlet ports for introduction of liquid to the suction side of the pump are selected from those ports 60 located forwardly of the mainfold valves 75L and 75R on either side of the pump. The valves 74L on the side adjacent to the inlet ports 60L are open while the valves 74R are closed, unless liquid is to be drawn in from one of the ports 60R along the opposite side of the truck. The discharge conduit 64 introduces liquids under pressure through the liquid inlet 20 as solid particulate material is introduced through the upper solids inlet 14 into the blender. The mixed material discharged through the outlet 22 will then be conducted through the conduit 70 into the rearward transverse manifold 72. Assuming that the mix is to be discharged from the rearward ports along the outboard manifold 67L, the valve 74L leading into the outboard manifold 67L is open while the valve 74R leading into the other outboard mainfold 67R is closed.

In certain cases it may be desirable to recirculate at least a selected proportion of mixture from the discharge 22 of the blender through the liquid inlet 20 for further mixing in which event the material to be recirculated is reintroduced after discharge through one of the suction ports 60 and pumped into the blender. Furthermore, the entire blender 10 may be bypassed when, for example, it is desired to employ the closed loop system for flushing operations and no mixing or blending of materials is required. Thus, flow control valves 94 and 95 at the liquid inlet 20 and discharge 22, respectively, are open and, for instance, the liquid supply source will be pumped through the blender 10 for flushing same then into discharge conduit 70, the bypass conduit 78 and back through the discharge line leading from the blender for distribution or discharge through other selected ports 60 on either of the outboard manifolds 67. Assuming that the liquid is introduced through forward inlet ports 60 along the outboard mainfold 67R and is to be discharged through rearward ports on the outboard manifold 67L, each of the valves 75L and 75R would be closed with the valve 75R adjacent to outboard manifold 67R and the opposite valve 74L adjacent to manifold 67L opened so that the liquid can be pumped through the conduit 70 and manifold 72 into the rearward discharge ports 60L on the outboard manifold 67L. Similarly, the valve 74L in the manifold 66 on the side of the outboard manifold 67L would be closed while the other valves 74R would be open to permit introduction of the liquid into the intake side of the pump.

EXAMPLE

In a typical application of the blending apparatus shown in FIGS. 1 and 2 the truck is located in close proximity to the well head site and, depending upon accessibility to a source of water supply, one or more of the ports 60L or 60R toward the front end of the associated manifold 67 is connected to a delivery line from the water supply source. For instance if the water supply is on the left side of the truck, eight suction hoses will be connected to the ports 60 and valves 76 will be open. Initially, a mixture of 500 gallons of 2% KCL and water are combined to load the hole and to test the lines to the wellhead. Once the unit is started and mixer 10 and pump 62 are operating, the valves 74L and 75L connected to the water supply source will be opened. Fluid will then enter the pump 62 and fill the discharge line 68. Valves 20 and 22 are open so that the fluid will enter the mixer 10 then be discharged into line 72. By opening valves 74R and 75R the fluid will discharge from the right side of the truck through valves 76R.

The fluid is discharged into suitable pumping units which receive the fluid from delivery lines or hoses connected to ports 60R on the truck so as to fill the hole at any desired flow rate below the maximum rate of the pump 62. At the same time the blender is operated to dump 175 pounds of KCL per 1000 gallons of water into the mixer 10 by means of a suitable conveyor belt or screw auger which communicates with the upper solids inlet 14 of the blender.

In the second stage, the blender operator may connect one of the suction lines to a source of 7½% HCL solution and pump 500 gallons of the fluid to which is added 10 lbs. of citric acid for the purpose of cleaning the casing perforations. Following the second stage, 30,000 gallons of water are pumped through the blending apparatus and are gelled with 40 lbs. of guar gum per 1,000 gallons of water, and 75,000 lbs. of 10 to 20 mesh sand. Preferably the materials are mixed or blended beginning with 0 lbs. per gallons concentration and increasing by 1 lb. per gallon of sand for every 5,000 gallons of fluid pumped into the well. Finally, 500 gallons of 2% KCL are introduced in order to displace all of the fluid and sand into the formation.

From the foregoing description it will be seen that a novel and improved method and apparatus has been devised for introducing liquids from a closed loop system into a subsurface formation, although its application to other uses will be readily appreciated. A particular advantage in the utilization of the improved form of blender apparatus as described is that by virtue of the divergency of the annular chamber leading away from the tangentially directed liquid inlet, the liquid stream will be caused to follow a helical course throughout the annular chamber and in intercepting the solid materials driven into the liquid stream by the impeller will tend to cause the solid materials to become intimately mixed with the liquid and to be carried with the swirling liquid stream out through the discharge end of the blender. The divergency of the chamber is such that its cross sectional area at the discharge end will approximate twice the area at the inlet end and, as the swirling stream advances through the chamber and particularly along the area outwardly of the impeller zone will retain the sand or other solid materials along the outer wall of the chamber so as to continue to advance with the liquid and not tend to collect along the inner walls or bottom of the chamber.

Accordingly, it is to be understood that various modifications and changes may be made in the preferred method and apparatus of the present invention as herein described without departing from the spirit and scope thereof as defined by the appended claims.

I claim:

1. A method for mixing materials in a liquid stream, which comprises introducing liquid into a chamber near an upper end thereof, such that said liquid flows in a generally helical path in said chamber; introducing a material into said chamber at a central location of its upper end and imparting a centrifugal force to said material such that it contacts said helically flowing liquid in a portion of the chamber which serves as a mixing zone, and is mixed with the liquid in said zone; discharging a mixture of the liquid and the material from the chamber at a location near the lower end of said chamber.

2. A method as defined in claim 1, which further comprises isolating the material introduced into said chamber at central location of its upper end from the liquid until said material is in said mixing zone.

3. A method as defined in claim 2, wherein centrifugal force is imparted to said material by an impeller means which includes a series of radially extending vanes disposed in equally spaced circumferential relation, and which further comprises introducing said material into said chamber through an upper central opening in a housing defining said chamber at least in part, said impeller means being in open communication with said opening.

4. A method as defined in claim 3, wherein said chamber is defined in part by an inner wall of substantially uniform diameter throughout, the diameter of said inner wall correspondidng substantially to the outer diameter of said impeller means.

5. A method as defined in claim 3, wherein said impeller means includes upper and lower spaced plates with said impeller vanes extending radially between said upper and lower spaced plates, said upper plate having radially extending ribs on the surfaces thereof opposite to said impeller vanes.

6. A method as defined in claim 3, wherein said housing includes means defining a radially extending wall portion above said impeller means, said wall portion having a low coefficient of friction surface in confronting relation to said ribs on said upper plate of the impeller means.

7. A method as defined in claim 6, wherein said lower plate of the impeller means also has radially extending ribs on the surface thereof opposite said vanes; and wherein there is means defining a lower wall portion beneath said impeller means having a low coefficient of friction surface in confronting relation to said ribs on said lower plate of the impeller means.

8. A method as defined in claim 7, wherein said low coefficient of friction material is composed of Teflon.

9. A method as defined in claim 8, wherein said ribs project in equally spaced relation along said upper and lower spaced plates.

10. A method for mixing materials in a liquid stream, which comprises introducing liquid into a chamber near an upper end thereof, such that the liquid flows in a generally helical path in said chamber, introducing a material into said chamber at a central location of its upper end and imparting a centrifugal force to said material such that it contacts said helically flowing liquid in an annular portion of the chamber which serves as a mixing zone, and is mixed with the liquid in said zone, said liquid and said material being isolated from one another until said material is in said mixing zone; and removing a mixture of the liquid and the material from said chamber.

11. A method as defined in claim 10, wherein centrifugal force is imparted to said material by an impeller means which includes upper and lower spaced plates and impeller vanes extending radially between said upper and lower spaced plates.

12. A method for mixing materials in a liquid stream, which comprises introducing liquid into a chamber near an upper end thereof, such that said liquid flows in a generally helical path in said chamber; introducing a material into said chamber at a central location of its upper end and imparting a centrifugal force to said material such that it contacts said helically flowing liquid, said force being imparted by impeller means including upper and lower spaced plates and impeller vanes extending generally radially therebetween, said upper plate having a central opening for receiving material introduced at said central location, the impeller means being dimensioned relative to the chamber to define therewith an annular mixing zone in the chamber, said material supplied to the impeller and the liquid being isolated from one another until the material is in said mixing zone; and removing a mixture of the material and the liquid from said chamber.

13. A method for mixing a liquid and a solid material, which comprises introducing a solid material into a chamber through an inlet; imparting a centrifugal force to the solid material introduced through said inlet; directing the liquid such that it intercepts solid material to which centrifugal force has been imparted and intermixture of solid material and said liquid is effected, said solid material and said liquid being isolated from one another until the solid material is intercepted by said liquid; discharging the mixture of liquid and solid material under pressure from said chamber; and selectively controlling the quantities of mixed material and liquid respectively discharged from said chamber into a plurality of discharge manifolds.

14. A method as defined in claim 13, which further comprises recycling some of said mixture from at least one of said manifolds back to the chamber.

15. A method as defined in claim 13, wherein each of said manifolds has a series of discharge parts connected in parallel to said manifold, said valve means in each of said discharge parts to control selectively the quantity of materials discharged therefrom.

16. A method as defined in claim 13, wherein some of the mixture discharged from said chamber is directed through a bypass line back to said chamber inlet, and wherein valve means included in said bypass line selectively controls the quantity of said mixture discharged from said chamber which is recirculated through said chamber.

17. A method as defined in claim 13, wherein each of said manifolds includes a plurality of ports connected in parallel thereto, and valve means in each manifold operative to isolate said ports in each manifold whereby selected to said ports are operative to permit introduction of liquid from a source, for supplying liquid to said chamber, to a liquid pump connected to a delivery line communicating with said inlet, and other of said ports are operative for discharge of the mixture of material and liquid from said chamber.

18. A method of mixing and discharging liquid-to-liquid and liquid-to-solid constituents, which comprises introducing a material through a central inlet, into an outer concentric chamber, of apparatus mounted on a vehicle capable of movement from one location to another, and directing liquid under pressure to said chamber such that the liquid flows in a stream under pressure through said chamber relatively outwardly in respect of the location of the central inlet;

imparting a centrifugal force to the material introduced through said central inlet such that said material is directed outwardly into the stream of liquid, said material and said liquid under pressure being isolated from one another until said impartation of centrifugal force;

selectively regulating the proportionate amounts of mixed material and liquid respectively discharged from said chamber into a plurality of discharge manifolds.

19. A method as defined in claim 18, wherein each of said discharge manifolds is provided with a series of ports connected in parallel to one another, selected of said ports being connectable to the intake of a liquid supply pump for introduction of liquid from a liquid supply source into said liquid pump, and selected of said ports being in communication with a common discharge line from said chamber.

20. A method as defined in claim 19, wherein each of said manifolds is provided with valve means to isolate said selected intake ports from said selected dicharge ports in each manifold.

21. A method as defined in claim 18, each of said manifolds being provided with ports, each port including valve means to regulate the delivery of materials discharged from said chamber.

22. A method as defined in claim 18, said vehicle having a power transmission and a plurality of power takeoff shafts connected thereto, which further comprises driving the impartation of centrifugal force to said material with one power takeoff shaft and driving the introduction of liquid into said chamber with another one of said power takeoff shifts, said liquid introduction being driven at a rate less than said importation of centrifugal force.

23. A method as defined in claim 18, wherein said liquid is introduced into said chamber by the action of a liquid supply pump sized to generate liquid pressure within the designed pressure limit of said apparatus.

* * * * *